US006318698B1

(12) United States Patent
Hansen

(10) Patent No.: US 6,318,698 B1
(45) Date of Patent: Nov. 20, 2001

(54) SUSPENSION DEVICE FOR AN OBJECT

(76) Inventor: Carsten Hansen, Föreningsvägen 21, Saltsjö-Boo (SE), 132 37

( * ) Notice: Subject to any disclaimer, the term of this patent is extended or adjusted under 35 U.S.C. 154(b) by 0 days.

(21) Appl. No.: 09/508,704

(22) PCT Filed: Sep. 15, 1998

(86) PCT No.: PCT/SE98/01641

§ 371 Date: May 16, 2000

§ 102(e) Date: May 16, 2000

(87) PCT Pub. No.: WO99/13756

PCT Pub. Date: Mar. 25, 1999

(30) Foreign Application Priority Data

Sep. 15, 1997 (SE) ..... 9703321
Dec. 23, 1997 (SE) ..... 9704877

(51) Int. Cl.[7] ..... A47G 1/24
(52) U.S. Cl. ..... 248/495; 248/489
(58) Field of Search ..... 248/489, 495, 248/496, 323, 327, 493, 492

(56) References Cited

U.S. PATENT DOCUMENTS

| | | | | |
|---|---|---|---|---|
| 368,251 | * | 8/1887 | Stuebner | 248/495 |
| 681,380 | * | 8/1901 | Turner | 248/495 |
| 3,188,028 | * | 6/1965 | Waller | 248/489 |
| 3,285,549 | * | 11/1966 | Cook | 248/495 |
| 4,444,371 | * | 4/1984 | Ragen | 248/225.31 |
| 4,566,665 | | 1/1986 | Rynearson | 248/495 |

FOREIGN PATENT DOCUMENTS

| | | |
|---|---|---|
| 2221616 | 8/1988 | (GB) . |
| 8301109-8 | 3/1982 | (SE) . |
| WO9616580 | 6/1996 | (WO) . |

* cited by examiner

*Primary Examiner*—Anita King
*Assistant Examiner*—Gwendolyn Baxter
(74) *Attorney, Agent, or Firm*—Hovey, Williams, Timmons & Collins

(57) ABSTRACT

A suspension member for objects, preferably pictures, at a vertical surface. The device is intended to enable an exact positioning of a picture frame in a vertical direction in such a way that the picture hangs exactly straight. The suspension device comprises a base element for fastening of the suspension device, an elongated element, displaceably provided in relation to the base element, a suspension memeber which is provided on the elongated element and positioning structure arranged to enable a positioning of the elongated element in its longitudinal direction in relation to the base element, wherein the positioning structure is arranged to adjust in a continuous manner the elongated element in relation to the base element.

19 Claims, 3 Drawing Sheets

SUSPENSION DEVICE FOR AN OBJECT

BACKGROUND OF THE INVENTION

1. Field of the Invention

The present invention relates to a suspension device for an object, preferably pictures, at a vertical surface, comprising a base element for fastening of the suspension device, an elongated element displaceably provided in relation to the base element, a suspension member provided on the elongated element, and means arranged to enable the positioning of the elongated element in its longitudinal direction in relation to the base element.

2. Description of the Prior Art

Such suspension devices may be used for the suspension of for example pictures, whereby the position of the pictures in the vertical direction may be adjusted. It is especially important that the pictures may hang exactly straight at exhibitions, since the visual impression of a valuable work of art, partly may disappear if the picture is slanting.

Usually, the pictures are transported between different art exhibitions without suspension devices. Usually, suspension devices in form of two loops are attached by screws to the rear side of the picture frame in connection with the suspension of the work of art. Thereafter, the pictures are suspended by metal wires introduced into the loops. An exact adjustment of the pictures takes time and is relatively complicated to perform. Another problem is that the loops are removed after every occasion of suspension and new loops are attached at the next suspension. This leads to a great wear of the frame and deteriorate seriously the strength of the frame on the long view, and at the same time the possibilities to find new suitable positions for the loops decrease.

SE, A, 8301109-8 shows an adjustable suspension device comprising a base element for fastening of the device, and an elongated element having a fixed loop, wherein a toothed mechanism is provided to lock said elongated element in relation to the base element An exact positioning may not be performed by this device because it comprises fixed positions. Even if said toothed mechanism is performed very finely, an exact positioning may not be realised.

By GB, A, 2 221 666 a picture hanger is known, which is adjustable in a continuous manner, comprising a base element for the fastening, a rotatable elongated element and a nut which is provided thereon and to which a loop is fasten. The disadvantage of this picture hanger is that the loop is not fixedly provided, in relation to the other parts, but moveable in the vertical direction, Therefore, an exact adjustment of the picture in the vertical direction may be difficult to perform.

SUMMARY OF THE INVENTION

The object of the present invention is to provide a suspension device, preferably for pictures, which is possible to adjust exactly in the vertical direction. This is particularly important when more than one suspension device are utilised for an object, since a very exact adjustment is required so that the object will hang straight.

This object is obtained by the device initially defined which, according to the present invention, is characterised in that said means is arranged to adjust in a continuous manner the elongated element in relation to the base element. By this design of the suspension device a picture may be adjusted in a continuous manner exactly in the vertical direction. In that case when two suspension devices are used one of them may in a simple way be adjusted in such a manner that the picture is hanging exactly straight. According to a preferred embodiment of the suspension device, the suspension members are fixedly provided to the elongated element. By this embodiment the suspension member is adjusted together with the elongated element as a solid unit, wherein no relative moments between the suspension member and the base element, which disturb the adjustment work, may arise.

According to another preferred embodiment of the invention, the base element comprises a passage for receiving the elongated element and said means is provided at said passage. BY the passage is obtained that the elongated element is kept steadily in the base element and thereby effectively prevented from moving in any other directions than in its displacement direction. By providing said means at the passage, said means may immediately be in engagement with the elongated element without any additional movement transmission parts. In order to adjust the suspension member in a continuous manner in relation to the base member it is suitable to design said means comprising a rotatable unit. Thereby, for the adjustment of the suspension device, one may by rotating the unit by the fingers of the hand in a continuous manner adjust the elongated element in the vertical direction in relation to the base element.

According to a preferred embodiment of the invention, said rotatable unit comprises an essentially cylindrical shape having a rotation axis essentially in parallel to the extension of the elongated element. According to one embodiment of the rotatable unit, it comprises an internal passage arranged to receive the elongated element. This passage is provided to be aligned with the passage of the base element. In order to obtain an adjustment in a continuous manner, said passage of the rotatable unit may comprise internal threads which are arranged to interact with threads provided on the elongated element. According to another embodiment of the rotatable unit, it comprises external threads, which are arranged to interact with threads provided on the elongated element. By the rotation of the rotatable unit, the external threads transmit a screw movement to the corresponding external threads provided on the elongated element, wherein the elongated element may be displaced in a continuous manner upwardly or downwardly in the passage.

According to another embodiment of said rotatable unit, it has an essentially cylindrical shape having a rotation axis essentially perpendicular to the extension of said elongated element. By this embodiment, which above all is intended for lighter suspension objects, said elongated element with the associated suspension member is provided manually in a desired position, whereafter said rotatable unit fixedly locks the elongated element in the passage. Said rotatable unit may comprise a screw device.

According to a preferred embodiment of the invention, the device comprises means arranged to keep the elongated element non-rotatable in relation to the base element during said adjustment in a continuous manner. Thereby, it is obtained that the suspension member, which is fixedly provided on the elongated element, is kept non-rotatable during said adjustment, which facilitates the adjustment work and leads to a better and quicker result. It is preferable, if the opening of the suspension member in this case is provided essentially perpendicular to said vertical surface in such a way that a wire during the suspension of the object simply may be threaded through the opening of the suspension member. Said means may comprise at least a pin member provided on the elongated element and an elongated gap provided in the base element, wherein the pin member is arranged to be guided in the gap. By an alternative embodiment of said means, which only is adapted to the second embodiment of the rotatable unit, the threads on the elongated element may only be provided on that part of its circumference, which is adjacent to said rotatable unit in order to prevent the elongated element with the associated suspension member from rotating during the displacement movement. It is also preferable, if the threads of the elongated element at their outer positions extend around a greater part of the circumference of the elongated element. Thereby, it is obtained that the suspension member with the associated opening, which member is fixedly provided on the elongated element, may be turned, for example about 90°. By such a turning of about 90° the suspension member is not protruding appreciably outside the rear delimiting surface of the suspension object and thereby the suspension device not need to be dismounted from the object by packing and transportation.

According to a preferred embodiment of the invention, said suspension member is provided to engage an element provided at the vertical surface. It is usual during the suspension of pictures, that said elements consist of metal wires. In order to make thefts more difficult said suspension member may comprise a closed loop. In order to provide a high strength and a long life time of the included parts of the suspension device, namely said base element, elongated element and suspension member, they may be manufactured in a metal material.

BRIEF DESCRIPTION OF THE DRAWINGS

Below, preferred embodiments of the invention are described by way of example with reference to the attached drawings, in which.

DETAILED DESCRIPTION OF PREFERRED EMBODIMENTS OF THE INVENTION

Figure 1:
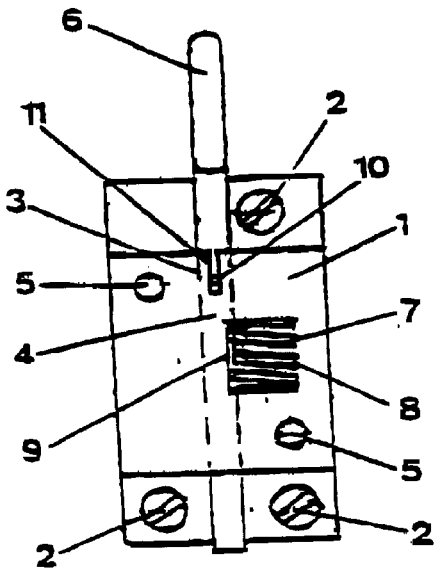
FIG. 1 shows a front view of a first embodiment of the invention.
Figure 2:
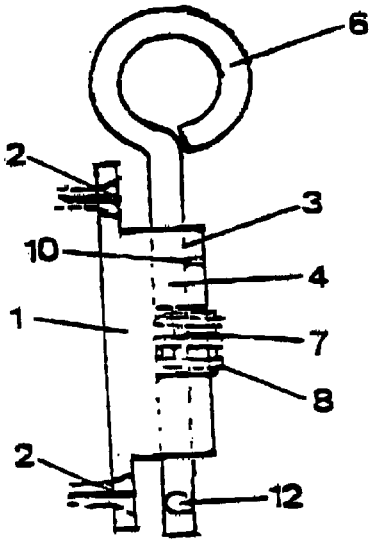
FIG. 2 shows a side view of the embodiment according to FIG. 1.

FIGS. 1 and 2 show a first embodiment of the invention, which preferably is used for hanging up large work of art and pictures. The embodiment comprises a base element 1 which is fasten to the rear part of the picture frame. Usually, two suspension devices are used for each picture, which are mounted to the rear part of the picture frame. The base element 1 is fasten to the rear part of the picture frame by screws 2. In order to fasten the base plate 1 in a stable manner to the picture frame, at least three screws 2 ought to be provided. The base element 1 comprises a passage 3 for receiving an elongated element 4 which is essentially rigid. The base element 1 also comprises threaded bottom holes 5 arranged, for example, to form an attachment for a transport sheet during the transportation of the picture. The elongated element 4 comprises at the top a fixedly provided suspension member 6 which is an integrated part of the elongated element 4 The suspension member 6 is constructed with a closed loop. This loop is in the figures essentially round but it may have an arbitrary shape it may, for example, be triangular with an edge located on the top towards the picture, whereby the picture may hang close to the suspension surface. When the picture is suspended, a metal wire is threaded through the hole of the closed loop 6. In order to adjust in a continuous manner the elongated element 4 in the vertical direction and thereby the suspension loop the suspension device comprises a rotatable unit 7 having an essentially cylindrical shape, by which the elongated element 4 may be displaceable in its longitudinal direction. The rotatable unit 7 is provided in parallel in relation to the elongated element 4. The rotatable unit 7 comprises external threads 8 interacting with threads 9 provided on the elongated element 4. These threads 9 are only provided on that part of the circumference of elongated element 4 which is adjacent to said rotatable unit 7. In order to obtain an entirely rigid and non-rotatable guiding of the elongated element 4 in an active position with the fixedly provided suspension loop 6, the elongated element 4 may comprise a pin 10, which is guided in an elongated gap 11 provided on the base element 1. In an outer position said pin 10 is displaced out of the gap 11, wherein the suspension loop 6 may be turned to its inactive transportation position. In an alternative embodiment without the pin 10 and the gap 11 (not shown in the figures), the elongated element 4 may comprise a cylindrical concave recess with threads 9 for receiving the convex cylindrical threaded part 8 of the rotatable unit 7. Thereby, the suspension loop 6 is kept in a non-rotatable position during adjustment of the suspension member in the vertical direction, However, the threads 9 of said elongated element 4 extend, at least an outer position, around a greater part of the circumference of the elongated element 4. The suspension loop is only in this position rotatable, preferably about 90°. This rotated position of the suspension loop 6 is used during storing and transportation of pictures, since in this case the suspension loop 6 does not protrude appreciably outside the delimiting surface of the picture frame. In order not to thread the elongated element 4 too far, a hole 12 is provided in the lower part of this element for receiving a stop peg, not shown When pictures with suspension devices according to the invention arrive to an art exhibition, the pictures have the suspension devices provided at the rear part of the picture frames, with the suspension loops 6 turned to an inactive position. When a picture is suspended, the suspension loop 6 firstly is rotated about 90° by the rotatable unit 7, in such a way that the suspension loop 6 has an essentially right angle to the vertical surface, where the picture is to be suspended. Thereafter, metal wires are threaded through each of the suspension loops 6 of the picture, whereupon the picture is adjusted in the vertical direction by an adjuster who brings his hand behind the picture frame where two suspension devices 7 usually at a distance from each other are provided. By a simple movement with the hand he may at least adjust one of the suspension devices by rotating the rotatable unit 7, whereby the suspension loop 6 is displaced in a continuous manner in the vertical direction until the desired vertical position is obtained, when the picture hangs exactly straight.

The advantage of this suspension device is that suspension of pictures may be performed in a very short time and with an exact adjustment in the vertical direction. Furthermore, no more suspension devices needs to be threaded onto and off the picture frames, which by the time may lead to wear of the frames and to the need of replacement.

Figure 3:
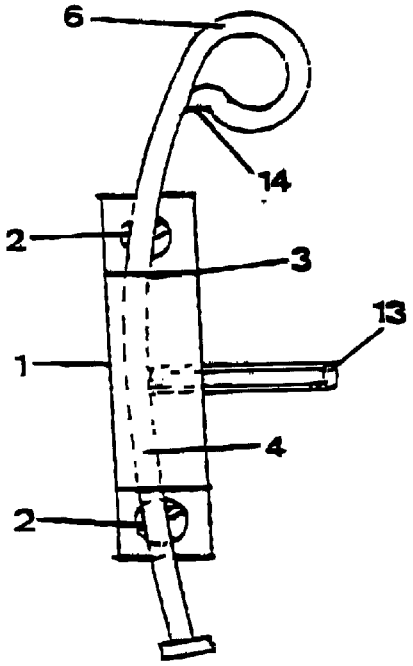
FIG. 3 shows a front view of a second embodiment.
Figure 4:
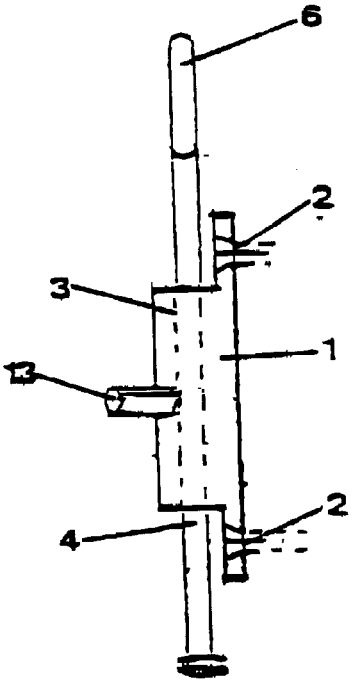
FIG. 4 shows a side view of the embodiment in FIG. 3.

An other embodiment of the invention is shown in FIGS. 3 and 4, which preferably may be used for lighter suspension objects. The invention according to this embodiment has a base plate 1, which is fastened by screws 2 to the r ear side of a picture frame. The base element 1 has a passage 3 for receiving an elongated element 4 having an integrated suspension member at the top in the form of a loop 6. This suspension device comprises a screw device 13 having a rotational axis essentially perpendicular to the extension of the elongated element 3. During the suspension of an object by this suspension device, a metal wire is first threaded through the suspension loop 6. Thereafter, the suspension loop 6 is manually adjusted in the passage 3 in relation to the base element 1 until a desired position in the vertical direction is obtained, Thereafter, the screw device 13 is rotated until said elongated element 4 is clamped fixedly in the passage 3 In this embodiment, the suspension loop 6 has a lower bend 14 directed inwardly, by which a picture, most frequently temporary, may be hanged on an edge or a metal wire. The suspension loop 6 may also, in this embodiment, be adjusted from en inactive position, where the loop 6 is essentially in parallel with the suspension object, to an active position, where the loop 6 is essentially perpendicular to said suspension object. This may for example be possible by a pin 10 and a gap 11, in corresponding way as in the embodiment according to FIGS. 1 and 2.

Figure 5:
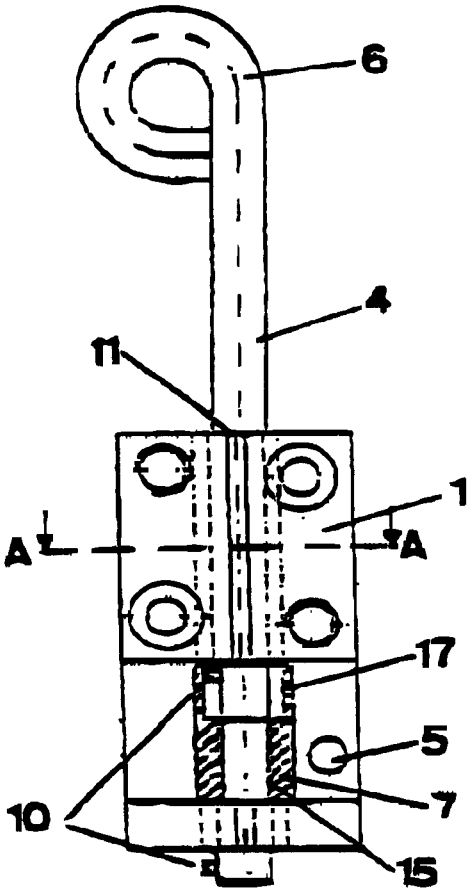
FIG. 5 shows a front view of a third embodiment.
Figure 6:
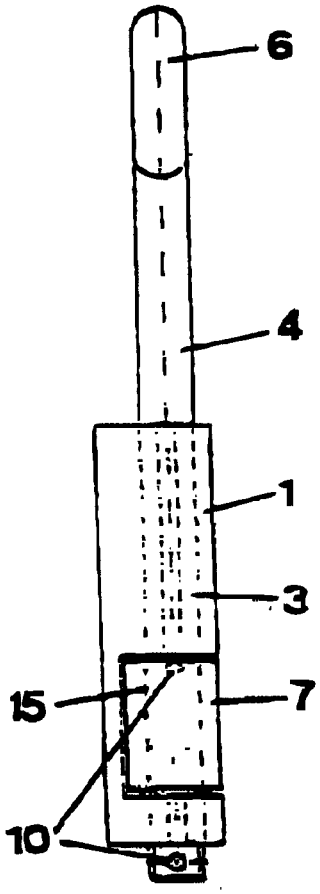
FIG. 6 shows a side view of the embodiment in FIG. 5
Figure 7:
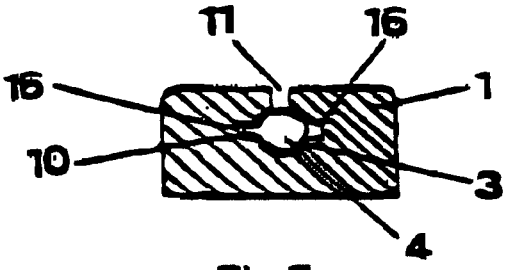
FIG. 7 shows a sectional view along the line A—A in FIG. 5.

FIGS. 5–7 show a third embodiment of the invention, which differs from that in FIGS. 1–2 by the fact that the rotatable unit 7 in this case comprises an internal passage 15 which is arranged to receive the elongated element 4. The internal passage 15 comprises internal threads arranged to interact with threads 9 provided a n the elongated element 4. Furthermore, the elongated element 4 comprises in this case two pin members 10 arranged to be guideable in an elongated gap 11 extending along the whole length of the base element 1, During the guiding in the elongated gap 11, the suspension loop 6 is located in an active position, where the loop 6 is essentially perpendicular to the suspension object. The base element comprises two further elongated gaps 16 located inside the passage 3, each of these being turned 90° in opposite direction in relation to the gap 11. During transportation, the pin member 10 of the elongated element 4 may be guided in one of these gaps 16, wherein the suspension loop 6 is located in an inactive transportation position where the loop 6 is essentially in parallel with the suspension object. The base element 1 is constructed with an upper portion and a lower portion, which comprise said passage 3 for receiving the elongated element 4. The rotatable unit 7 is provided between these portions and its internal passage 15 is shaped to connect the passage of the upper and lower portions of the base element 1, i.e. the internal passage of the unit 7 is essentially concentric to the passage 3. The upper and lower portions of the base element 1 are so shaped that they prevent in the vertical direction the displacement of the rotatable unit 7. Thereby, during rotation of the rotatable unit 7, the elongated element 4 may be displaced in a continuous manner in the passage 3 in the base element 1. By adjusting the suspension loop 6 from an active to an inactive position, the elongated element 4 is downwardly displaced by the rotatable unit 7, until the lower pin 10 of the elongated element 4 is located below the base element I and thereby out of engagement with the gap 11. In this position, the upper pin member 10 of the elongated element will be located at an upper end of the rotatable unit 7, which here comprises an essentially cylindrical recess 17. In this position, the elongated element 4 is freely rotatable. By turning the elongated element 4 by an angle of 90° and thereafter displace the elongated element 4 upwardly, by rotating the rotatable unit 7, the pin members 10 are guided into one of the gaps 16, wherein the suspension member 6 may be kept non-rotatable in an inactive transportation position.

Figure 8:
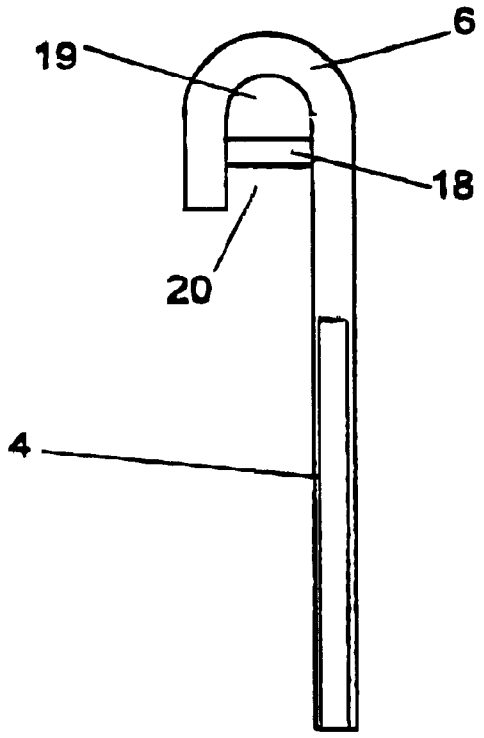
FIG. 8 shows an alternative embodiment of the elongated element according to the present invention.
Figure 9:
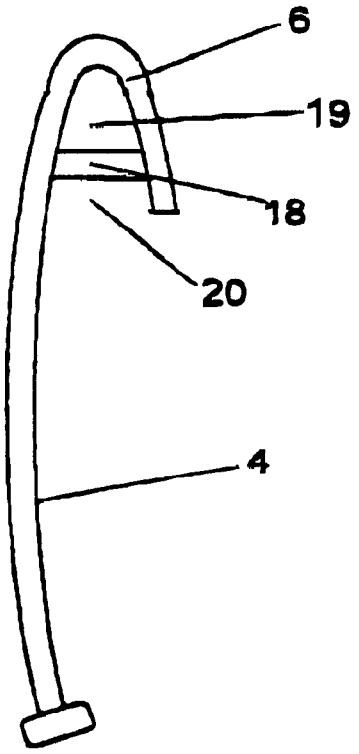
FIG. 9 shows another alternative embodiment of the elongated element according to the present invention.

FIGS. 8 and 9 show alternative embodiments of the elongated element 4 according to the present invention. The suspension member 6 provided on the top of that elongated element 4 has in this case a hook-shaped portion bent downwardly. A transverse element 18 is provided which separates the suspension member 6 in an upper closed portion 19, through which a metal wire may be threaded, and a lower open portion 20, which makes it possible to hang a picture on an edge or a metal wire.

The suspension device according to the invention is not in any way restricted to the shown embodiments but may be varied freely within the scope of the claims. The base element 1 needs for example not to be fastened to the suspension object but it may also be fastened to the vertical wall surface, wherein the suspension object instead discloses receiving elements, for example in the form of metal wires which are fastened in the suspension member.

What is claimed is:

1. A suspension device for an object at a vertical surface, comprising:

a base element for fastening of the suspension device to the object;

an elongated element displaceably provided in relation to the base element;

a suspension member which is provided to the elongated element;

means arranged to enable the positioning of the elongated element in the elongated element's longitudinal direction in relation to the base element wherein the suspension member is fixedly provided to the elongated element and wherein said means is arranged to adjust the elongated element in a continuous manner in relation to the base element; and means arranged to keep the elongated element non-rotatable in relation to the base element.

2. A suspension device according to claim 1, wherein the base element comprises a passage for receiving the elongated element.

3. A suspension device according to claim 2, wherein said means is provided at said passage.

4. A suspension device according to claim 1 wherein said means comprises a rotatable unit.

5. A suspension device according to claim 4, wherein said elongated element has an extension and said rotatable unit has a substantially cylindrical shape having a rotation axis essentially in parallel to the extension of the elongated element.

6. A suspension device according to claim 5, wherein said rotatable unit comprises an internal passage arranged to receive the elongated element.

7. A suspension device according to claim 6, wherein said internal passage comprises threads arranged to interact with threads provided on the elongated element.

8. A suspension device according to claim 4, wherein said rotatable unit comprises external threads, arrange to interact with threads provided on the elongated element.

9. A suspension device according to claim 8, wherein the threads provided on the elongated element are substantially only provided as a part of the circumference of the elongated element, adjacent to said rotatable unit.

10. A suspension device according to claim 9, wherein said threads of the elongated element in an outer position also extend around a greater part of the circumference of the elongated element.

11. A suspension device according to claim 8, including an element provided at the vertical surface and wherein said suspension member is provided to engage the element provided at the vertical surface.

12. A suspension device according to claim 4, wherein said elongated element has an extension and said rotatable unit comprises a substantially cylindrical shape having a rotation axis substantially perpendicular to the extension of said elongated element.

13. A suspension device according to claim 12, wherein said rotatable unit comprises a screw device.

14. A suspension device according to claim 4, including an element provided at the vertical surface and wherein said suspension member is provided to engage the element provided at the vertical surface.

15. A suspension device according to claim 4, wherein the device comprises means arranged to keep the elongated element non-rotatable in relation to the base element during the adjustment of the elongated element in a continuous manner.

16. A suspension device according to claim 1, wherein said means arranged to keep the elongated element non-rotatable comprises at least a pin member provided on the elongated element and including an elongated gap provided on the base element, wherein said pin member is arranged to be guided in the elongated gap.

17. A suspension device according to claim 1, including an element adapted to be provided at the vertical surface and wherein said suspension member is provided to engage the element provided at the vertical surface.

18. A suspension device according to claim 17, wherein said suspension member comprises a closed loop.

19. A suspension device according to claim 1, wherein said base element, elongated element and suspension member are manufactured of a metal material.

* * * * *